US006675898B2

(12) United States Patent
Staudt

(10) Patent No.: US 6,675,898 B2
(45) Date of Patent: Jan. 13, 2004

(54) APPARATUS FOR PREVENTING CRITICAL ANNULAR PRESSURE BUILDUP

(75) Inventor: John J. Staudt, Friendswood, TX (US)

(73) Assignee: Hunting Energy Services, LP, Houston, TX (US)

( * ) Notice: Subject to any disclaimer, the term of this patent is extended or adjusted under 35 U.S.C. 154(b) by 0 days.

(21) Appl. No.: 10/217,874

(22) Filed: Aug. 13, 2002

(65) Prior Publication Data

US 2003/0010503 A1 Jan. 16, 2003

Related U.S. Application Data

(62) Division of application No. 09/821,251, filed on Mar. 29, 2001, now Pat. No. 6,457,528.

(51) Int. Cl.[7] ..... E21B 29/12

(52) U.S. Cl. ..... 166/363; 166/242.1; 166/317

(58) Field of Search ..... 166/317, 242.1, 166/363, 368; 137/68.21, 68.28, 68.23

(56) References Cited

U.S. PATENT DOCUMENTS

| | | | | |
|---|---|---|---|---|
| 2,178,845 A | | 11/1939 | Baker | |
| 3,366,182 A | | 1/1968 | Solum | |
| 3,417,822 A | | 12/1968 | Howell | |
| 3,827,486 A | | 8/1974 | Hall | 166/5 |
| 3,882,935 A | | 5/1975 | Calhoun | 166/244 |
| 4,286,662 A | | 9/1981 | Page, Jr. | 166/317 |
| 4,582,149 A | * | 4/1986 | Slaughter, Jr. | 175/340 |
| 4,590,957 A | | 5/1986 | McFarlane | 137/68.1 |
| 4,750,510 A | | 6/1988 | Short, III | 137/1 |
| 5,020,600 A | * | 6/1991 | Coronado | 166/387 |
| 5,109,925 A | | 5/1992 | Stepp et al. | 166/184 |
| 5,161,738 A | * | 11/1992 | Wass | 236/92 C |
| 5,341,883 A | | 8/1994 | Ringgenberg | 166/324 |
| 5,411,097 A | | 5/1995 | Manke et al. | 166/324 |
| 6,095,247 A | | 8/2000 | Streich et al. | 166/299 |
| 6,176,311 B1 | * | 1/2001 | Ryan | 166/99 |
| 6,293,346 B1 | | 9/2001 | Patel | 166/373 |
| 6,450,263 B1 | * | 9/2002 | Schwendemann | 166/373 |
| 2001/0022225 A1 | * | 9/2001 | Burns et al. | 166/386 |

* cited by examiner

*Primary Examiner*—Hoang Dang
(74) *Attorney, Agent, or Firm*—Charles D. Gunter, Jr.

(57) ABSTRACT

A modified casing coupling and burst disk assembly are used to prevent critical annular pressure buildup in an offshore well. The modified casing coupling includes a receptacle, or receptacles, for a modular burst disk assembly. The burst disk assembly is retained by threads or a snap ring and is sealed by the retaining threads, or an integral o-ring seal. The disk fails at pressure specified by the user but before trapped annular pressure threatens the integrity of the outer casing. The design allows for the burst disk assembly to be installed on location or before pipe shipment.

8 Claims, 5 Drawing Sheets

APPARATUS FOR PREVENTING CRITICAL ANNULAR PRESSURE BUILDUP

CROSS REFERENCE TO RELATED APPLICATIONS

The present application is a divisional application of prior U.S. Ser. No. 09/821,251, filed Mar. 29, 2001, now U.S. Pat. No. 6,457,528, entitled "METHOD FOR PREVENTING CRITICAL ANNULAR PRESSURE BUILDUP", by the same inventor, and priority is claimed pursuant to 37 C.F.R. Section 1.78(a)(2).

BACKGROUND OF THE INVENTION

1. Technical Field

The present invention relates generally to a method for the prevention of damage to oil and gas wells, and, more specifically, to the prevention of damage to the well casing from critical annular pressure buildup.

2. Description of the Related Art

The physics of annular pressure buildup (APB) and associated loads exerted on well casing and tubing strings have been experienced since the first multi-string completions. APB has drawn the focus of drilling and completion engineers in recent years. In modern well completions, all of the factors contributing to APB have been pushed to the extreme, especially in deep water wells.

APB can be best understood with reference to a subsea wellhead installation. In oil and gas wells it is not uncommon that a section of formation must be isolated from the rest of the well. This is typically achieved by bringing the top of the cement column from the subsequent string up inside the annulus above the previous casing shoe. While this isolates the formation, bringing the cement up inside the casing shoe effectively blocks the safety valve provided by nature's fracture gradient. Instead of leaking off at the shoe, any pressure buildup will be exerted on the casing, unless it can be bled off at the surface. Most land wells and many offshore platform wells are equipped with wellheads that provide access to every casing annulus and an observed pressure increase can be quickly bled off. Unfortunately, most subsea wellhead installations do not have access to each casing annulus and often a sealed annulus is created. Because the annulus is sealed, the internal pressure can increase significantly in reaction to an increase in temperature.

Most casing strings and displaced fluids are installed at near-static temperatures. On the sea floor the temperature is around 34° F. The production fluids are drawn from "hot" formations that dissipate and heat the displaced fluids as the production fluid is drawn towards the surface. When the displaced fluid is heated, it expands and a substantial pressure increase may result. This condition is commonly present in all producing wells, but is most evident in deep water wells. Deep water wells are likely to be vulnerable to annular pressure buildup because of the cold temperature of the displaced fluid, in contrast to elevated temperature of the production fluid during production. Also, subsea wellheads do not provide access to all the annulus and any pressure increase in a sealed annulus cannot be bled off. Sometimes the pressure can become so great as to collapse the inner string or even rupture the outer string, thereby destroying the well.

One previous solution to the problem of APB was to take a joint in the outer string casing and mill a section off so as to create a relatively thin wall. However, it was very difficult to determine the pressure at which the milled wall would fail or burst. This could create a situation in which an overly weakened wall would burst when the well was being pressure tested. In other cases, the milled wall could be too strong, causing the inner string to collapse before the outer string bursts.

What is needed is a casing coupling which reliably holds a sufficient internal pressure to allow for pressure testing of the casing, but which will collapse or burst at a pressure slightly less than collapse pressure of the inner string or the burst pressure of the outer string.

BRIEF SUMMARY OF THE INVENTION

It is an object of the present invention to provide a casing coupling that will hold a sufficient internal pressure to allow for pressure testing of the casing but which will reliably release when the pressure reaches a predetermined level.

It is another object of the present invention to provide a casing coupling that will release at a pressure less than the collapse pressure of the inner string and less than the burst pressure of the outer string.

It is yet another object of the present invention to provide a casing coupling that is relatively inexpensive to manufacture, easy to install, and is reliable in a fixed, relatively narrow range of pressures.

The above objects are achieved by creating a casing coupling modified to include at least one receptacle for housing a modular bust disk assembly wherein the burst disk assembly fails at a pressure specified by a user. The burst disk assembly is retained in a suitable manner, as by threads or a snap ring and is sealed by either the retaining threads, or an integral o-ring seal. The pressure at which the burst disk fails is specified by the user, and is compensated for temperature. The disk fails when the trapped annular pressure threatens the integrity of either the inner or outer casing. The design allows for the burst disk assembly to be installed on location or before pipe shipment.

Additional objects, features and advantages will be apparent in the written description which follows.

BRIEF DESCRIPTION OF THE DRAWINGS

The novel features believed characteristic of the invention are set forth in the appended claims. The invention itself however, as well as a preferred mode of use, will best be understood by reference to the following detailed description of an illustrative embodiment when read in conjunction with the accompanying drawings, wherein:

DETAILED DESCRIPTION OF THE PREFERRED EMBODIMENT

Figure 3:
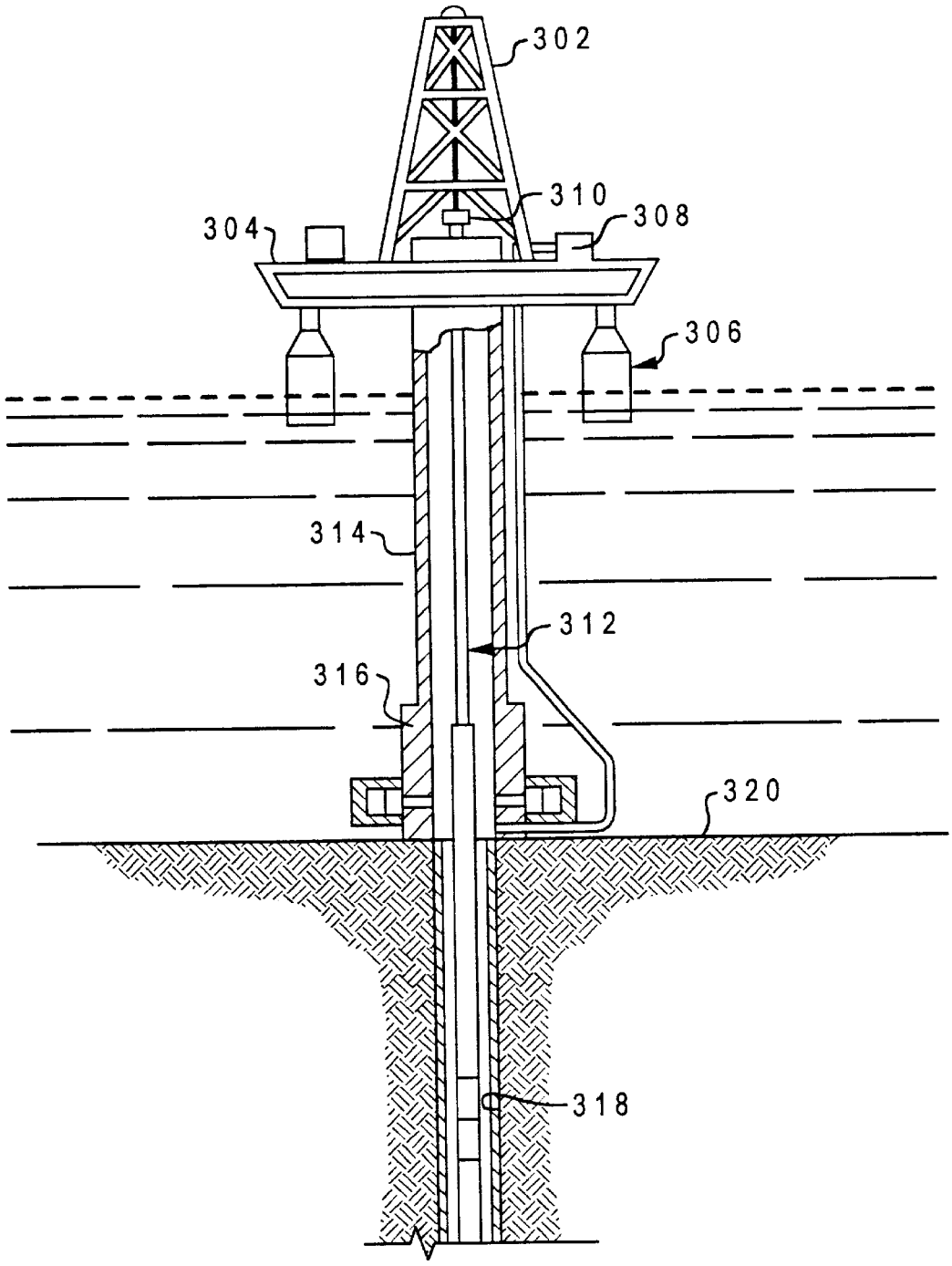
FIG. 3 is a simplified view of a typical off-shore well rig.

FIG. 3 shows a simplified view of a typical offshore well rig. The derrick 302 stands on top of the deck 304. The deck 304 is supported by a floating work station 306. Typically, on the deck 304 is a pump 308 and a hoisting apparatus 310 located underneath the derrick 302. Casing 312 is suspended from the deck 304 and passes through the subsea conduit 314, the subsea well head installation 316 and into the borehole 318. The subsea well head installation 316 rests on the sea floor 320.

During construction of oil and gas wells, a rotary drill is typically used to bore through subterranean formations of the earth to form the borehole 318. As the rotary drill bores through the earth, a drilling fluid, known in the industry as a "mud," is circulated through the borehole 318. The mud is usually pumped from the surface through the interior of the drill pipe. By continuously pumping the drilling fluid through the drill pipe, the drilling fluid can be circulated out the bottom of the drill pipe and back up to the well surface through the annular space between the wall of the borehole 318 and the drill pipe. The mud is usually returned to the surface when certain geological information is desired and when the mud is to be recirculated. The mud is used to help lubricate and cool the drill bit and facilitates the removal of cuttings as the borehole 318 is drilled. Also, the hydrostatic pressure created by the column of mud in the hole prevents blowouts which would otherwise occur due to the high pressures encountered within the wellbore. To prevent a blow out caused by the high pressure, heavy weight is put into the mud so the mud has a hydrostatic pressure greater than any pressure anticipated in the drilling.

Different types of mud must be used at different depths because the deeper the borehole 318, the higher the pressure. For example, the pressure at 2,500 ft. is much higher than the pressure at 1,000 ft. The mud used at 1,000 ft. would not be heavy enough to use at a depth of 2,500 ft. and a blowout would occur. In subsea wells the pressure at deep depths is tremendous. Consequently, the weight of the mud at the extreme depths must be particularly heavy to counteract the high pressure in the borehole 318. The problem with using a particularly heavy mud is that if the hydrostatic pressure of the mud is too heavy, then the mud will start encroaching or leaking into the formation, creating a loss of circulation of the mud. Because of this, the same weight of mud cannot be used at 1,000 feet that is to be used at 2,500 feet. For this reason, it is impossible to put a single casing string all the way down to the desired final depth of the borehole 318. The weight of the mud necessary to reach the great depth would start encroaching and leaking into the formation at the more shallow depths, creating a loss of circulation.

To enable the use of different types of mud, different strings of casing are employed to eliminate the wide pressure gradient found in the borehole 318. To start, the borehole 318 is drilled to a depth where a heavier mud is required and the required heavier mud has such a high hydrostatic pressure that it would start encroaching and leaking into the formation at the more shallow depths. This generally occurs at a little over 1,000 ft. When this happens, a casing string is inserted into the borehole 318. A cement slurry is pumped into the casing and a plug of fluid, such as drilling mud or water, is pumped behind the cement slurry in order to force the cement up into the annulus between the exterior of the casing and the borehole 318. The amount of water used in forming the cement slurry will vary over a wide range depending upon the type of hydraulic cement selected, the required consistency of the slurry, the strength requirement for a particular job, and the general job conditions at hand.

Typically, hydraulic cements, particularly Portland cements, are used to cement the well casing within the borehole 318. Hydraulic cements are cements which set and develop compressive strength due to the occurrence of a hydration reaction which allows them to set or cure under water. The cement slurry is allowed to set and harden to hold the casing in place. The cement also provides zonal isolation of the subsurface formations and helps to prevent sloughing or erosion of the borehole 318.

After the first casing is set, the drilling continues until the borehole 318 is again drilled to a depth where a heavier mud is required and the required heavier mud would start encroaching and leaking into the formation. Again, a casing string is inserted into the borehole 318, generally around 2,500 feet, and a cement slurry is allowed to set and harden to hold the casing in place as well as provide zonal isolation of the subsurface formations, and help prevent sloughing or erosion of the borehole 318.

Another reason multiple casing strings may be used in a bore hole is to isolate a section of formation from the rest of the well. In the earth there are many different layers with each made of rock, salt, sand, etc. Eventually the borehole 318 is drilled into a formation that should not communicate with another formation. For example, a unique feature found in the Gulf of Mexico is a high pressure fresh water sand that flows at a depth of about 2,000 feet. Due to the high pressure, an extra casing string is generally required at that level. Otherwise, the sand would leak into the mud or production fluid. To avoid such an occurrence, the borehole 318 is drilled through a formation or section of the formation that needs to be isolated and a casing string is set by bringing the top of the cement column from the subsequent string up inside the annulus above the previous casing shoe to isolate that formation. This may have to be done as many as six times depending on how many formations need to be isolated. By bringing the cement up inside the annulus above the previous casing shoe the fracture gradient of the shoe is blocked. Because of the blocked casing shoe, pressure is prevented from leaking off at the shoe and any pressure buildup will be exerted on the casing. Sometimes this excessive pressure buildup can be bled off at the surface or a blowout preventor (BOP) can be attached to the annulus.

However, a subsea wellhead typically has an outer housing secured to the sea floor and an inner wellhead housing received within the outer wellhead housing. During the completion of an offshore well, the casing and tubing hangers are lowered into supported positions within the wellhead housing through a BOP stack installed above the housing. Following completion of the well, the BOP stack is replaced by a Christmas tree having suitable valves for controlling the production of well fluids. The casing hanger is sealed off with respect to the housing bore and the tubing hanger is sealed off with respect to the casing hanger or the housing bore, so as to effectively form a fluid barrier in the annulus between the casing and tubing strings and the bore of the housing above the tubing hanger. After the casing hanger is positioned and sealed off, a casing annulus seal is installed for pressure control. On every well there is a casing annulus seal. If the seal is on a surface well head, often the seal can have a port that communicates with the casing annulus. However, in a subsea wellhead housing, there is a large diameter low pressure housing and a smaller diameter high pressure housing. Because of the high pressure, the high pressure housing must be free of any ports for safety. Once the high pressure housing is sealed it off, there is no way to have a hole below the casing hanger for blow out preventor purposes. There are only solid annular members with no means to relieve excessive pressure buildup.

Figure 4:
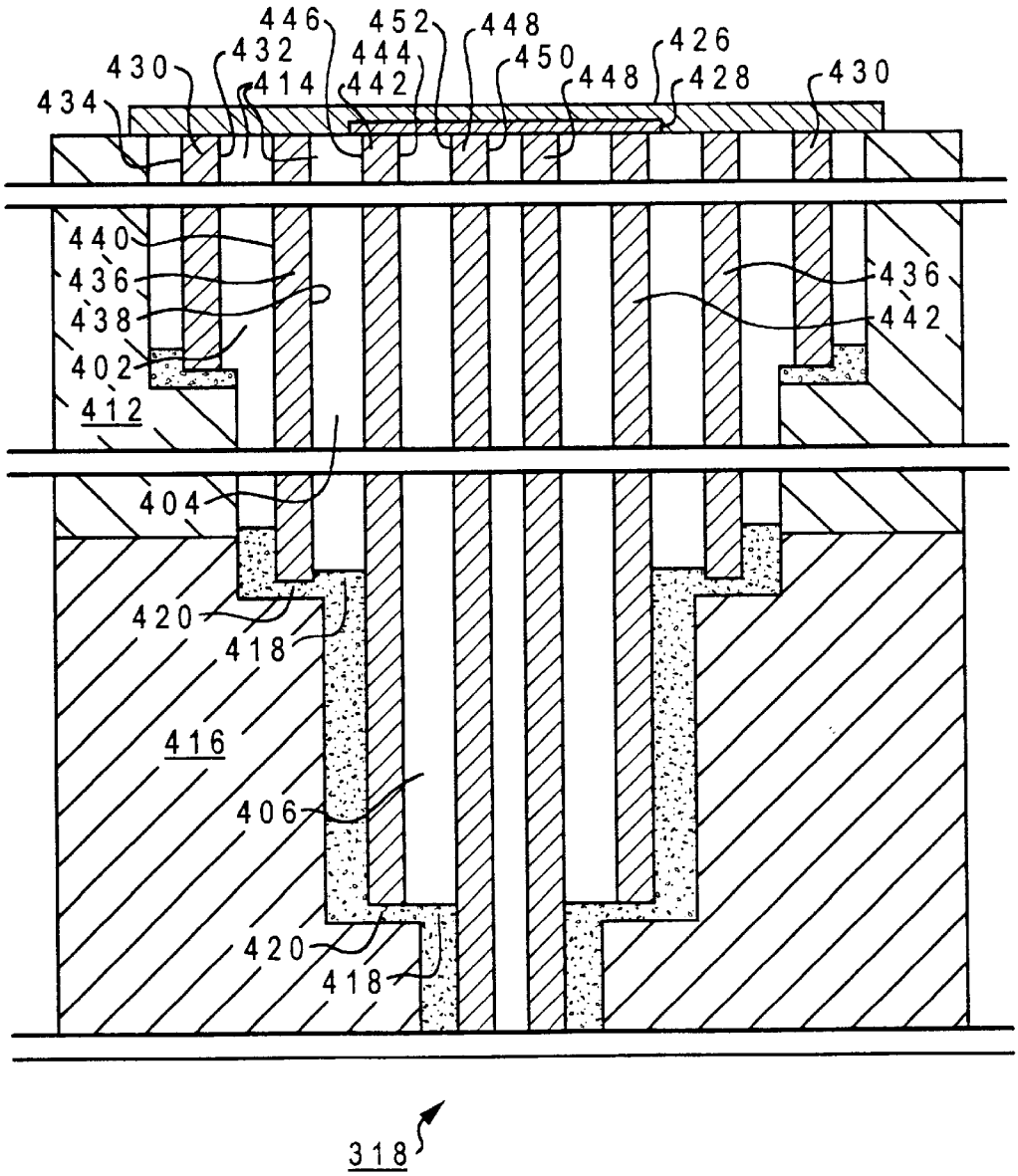
FIG. 4 is a cross sectional view of a bore hole.

FIG. 4 shows a simplified view of a multi string casing in the borehole 318. The borehole 318 contains casing 430, which has an inside diameter 432 and an outside diameter 434, casing 436, which has an inside diameter 438 and an outside diameter 440, casing 442, which has an inside diameter 444 and an outside diameter 446, casing 448, which has an inside diameter 450 and an outside diameter 452. The inside diameter 432 of casing 430 is larger than the outside diameter 440 of casing 436. The inside diameter 438 of casing 436 is larger than the outside diameter 446 of casing 442. The inside diameter 444 of casing 442 is larger than the outside diameter 452 of casing 448. Annular region 402 is defined by the inside diameter 432 of casing 430 and the outside diameter 440 of casing 436. Annular region 404 is defined by the inside diameter 438 of casing 436 and the outside diameter 446 of casing 442. Annular region 406 is defined by the inside diameter 444 of casing 442 and the outside diameter 452 of casing 448. Annular regions 402 and 404 are located in the low pressure housing 426 while annular region 406 is located in the high pressure housing 428. Annular region 402 depicts a typical annular region. If a pressure increase were to occur in the annular region 402, the pressure could escape either into formation 412 or be bled off at the surface through port 414. In the annular region 404 and 406, if a pressure increase were to occur, the pressure increase could not escape into the adjacent formation 416 because the formation 416 is a formation that must be isolated from the well. Because of the required isolation, the top of the cement 418 from the subsequent string has been brought up inside the annular regions 404 and 406 above the previous casing shoe 420 to isolate the formation 416. A pressure build up in the annular region 404 can be bled off because the annular region 404 is in the low pressure housing 426 and the port 414 is in communication with the annulus and can be used to bled off any excessive pressure buildup. In contrast, annular region 406 is in the high pressure housing 428 and is free of any ports for safety. As a result, annular region 406 is a sealed annulus. Any pressure increase in annular region 406 cannot be bled off at the surface and if the pressure increase gets to great, the inner casing 448 may collapse or the casing surrounding the annular region 406 may burst.

Sometimes a length of fluid is trapped in the solid annular members between the inside diameter and outside diameter of two concentric joints of casing. At the time of installation, the temperature of the trapped annular fluid is the same as the surrounding environment. If the surrounding environment is a deep sea bed, then the temperature may be around 34° F. Excessive pressure buildup is caused when well production is started and the heat of the produced fluid, 110° F.–300° F, causes the temperature of the trapped annular fluid to increase. The heated fluid expands, causing the pressure to increase. Given a 10,000 ft., 3½-inch tubing inside a 7-inch 35 ppf (0.498-inch wall) casing, assume the 8.6-ppg water-based completion fluid has a fluid thermal expansivity of $2.5\times10^{-4}R^{-1}$ and heats up an average of 70° F. during production.

When an unconstrained fluid is heated, it will expand to a larger volume as described by:

$$V=V_o(1+\alpha\Delta T)$$

Wherein:

V=Expanded volume, in.$^3$ $V_o$=Initial volume, in.$^3$ $\alpha$=Fluid thermal expansivity, $R^{-1}$ $\Delta T$=Average fluid temperature change, ° F.

The fluid expansion that would result if the fluid were bled off is:

$$V_o=10{,}000(\pi/4)(6.004^2-3.5^2/144=1{,}298ft^3=231.2\ bbl$$

$$V=231.2[1+(2.5\times10^{-4}\times70)]=235.2\ bl$$

$$\Delta V=4.0\ bbl$$

The resulting pressure increase if the casing and tubing are assumed to form in a completely rigid container is:

$$\Delta P=(V-V_o)/V_oB_N$$

Wherein:

V=Expanded volume, in.$^3$ $V_o$=Initial volume, in.$^3$ $\Delta P$=Fluid pressure change, psi $B_N$=Fluid compressibility, psi$^{-1}$ $$\Delta P=2.5\times10^{-4}\times70/2.8\times10^{-6}=6{,}250\ psi.$$

The resulting pressure increase of 6,250 psi can easily exceed the internal burst pressure of the outer casing string, or the external collapse pressure of the inner casing string.

Figure 1A:
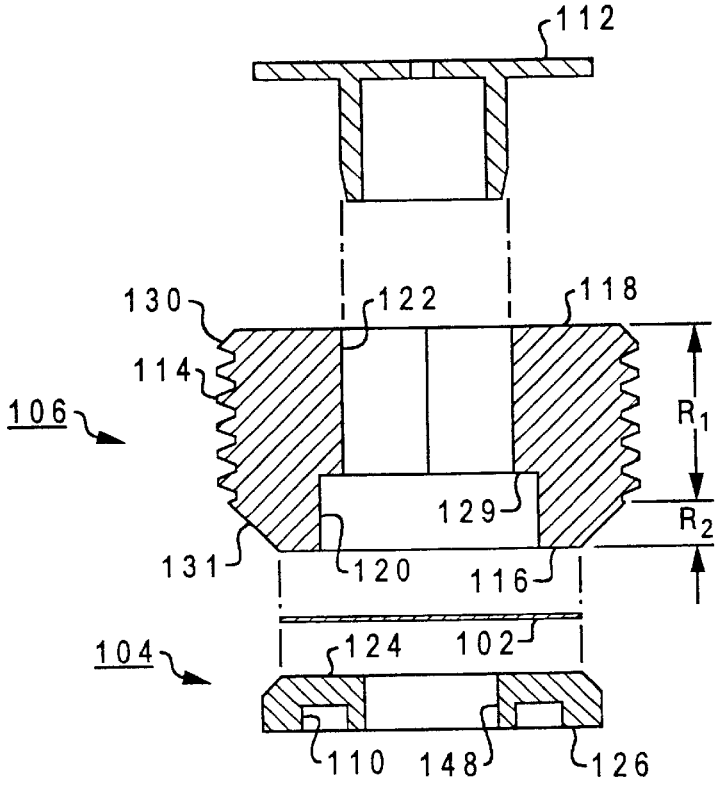
FIG. 1A is a cross sectional, exploded view of a burst disk assembly.
Figure 1B:
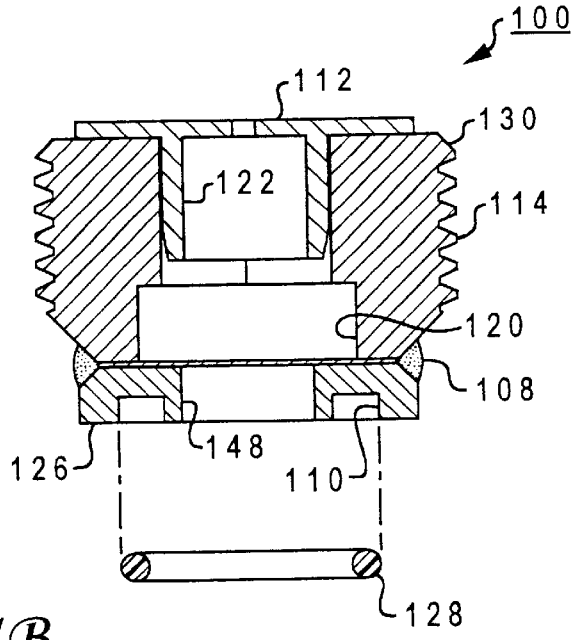
FIG. 1B is a cross sectional view of an assembled burst disk assembly.

The proposed invention is comprised of a modified casing coupling that includes a receptacle, or receptacles, for a modular burst disk assembly. Referring first to FIGS. 1A and 1B of the drawings, the preferred embodiment of a burst disk assembly of the invention is illustrated generally as 100. The burst disk assembly 100 included a burst disk 102 which is preferably made of INCONEL™, nickel-base alloy containing chromium, molybdenum, iron, and smaller amounts of other elements. Niobium is often added to increase the alloy's strength at high temperatures. The nine or so different commercially available INCONEL™ alloys have good resistance to oxidation, reducing environments, corrosive environments, high temperature environments, cryogenic temperatures, relaxation resistance and good mechanical properties. Similar materials may be used to create the burst disk 102 so long as the materials can provide a reliable burst range within the necessary requirements.

The burst disk 102 is interposed in between a main body 106 and a disk retainer 104 made of 316 stainless steel. The main body 106 is a cylindrical member having an outer diameter of 1.250-inches in the preferred embodiment illustrated. The main body 106 has an upper region $R_1$ having a height of approximately 0.391-inches and a lower region $R_2$ having a height of approximately 0.087-inches which are defined between upper and lower planar surfaces 116, 118. The upper region also comprises an externally threaded surface 114 for engaging the mating casing coupling, as will be described. The upper region $R_1$ may have a chamfered edge 130 approximately 0.055-inches long and having a maximum angle of about 45°. The lower region $R_2$ also has a chamfer 131 which forms an approximate 45° angle with respect to the lower surface 116. The lower region $R_2$ has an internal annular recess 120 approximately 0.625-inches in diameter through the central axis of the body 106. The dimensions of the internal annular recess 120 can vary depending on the requirements of a specific use. The upper region $R_1$. of the main body 106 has a ½ inch hex hole 122 for the insertion of a hex wrench. The internal annular recess 120 and hex hole 122 form an internal shoulder 129 within the interior of the main body 106.

The disk retainer 104 is approximately 0.172-inches in height and has a top surface 124 and a bottom surface 126. The disk retainer 104 has a continuous bore 148 approximately 0.375-inches in diameter through the central axis of the disk retainer 104. The bore 148 communicates the top surface 124 and the bottom surface 126 of disk retainer 104.

The bottom surface 126 contains an o-ring groove 110, approximately 0.139-inches wide, for the insertion of an o-ring 128.

The burst disk 102 is interposed between the lower surface 116 of the main body 106 and the top surface 124 of the disk retainer 104. The main body 106, disk 102, and disk retainer 104 are held together by a weld (108 in FIG. 1B). A protective cap 112 maybe inserted into the hex hole 122 to protect the burst disk 102. The protective cap may be made of plastic, metal, or any other such material that can protect the burst disk 102.

Figure 2A:
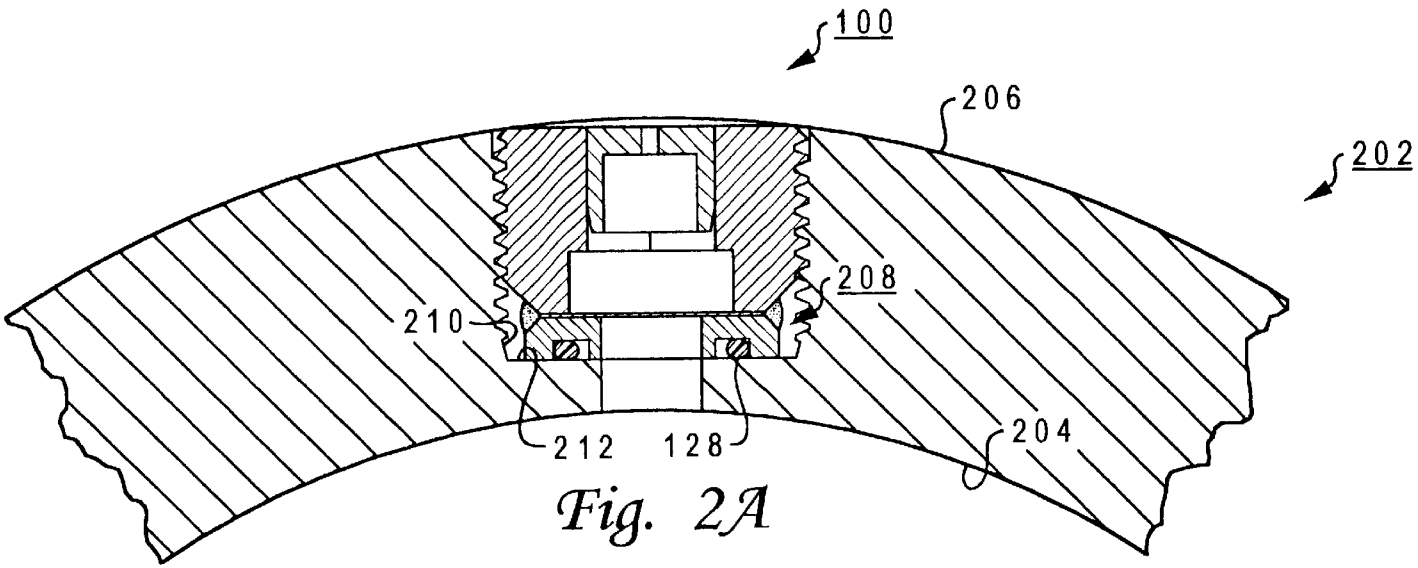
FIG. 2A is a cross sectional view of burst disk assembly installed in a casing using threads.
Figure 2B:
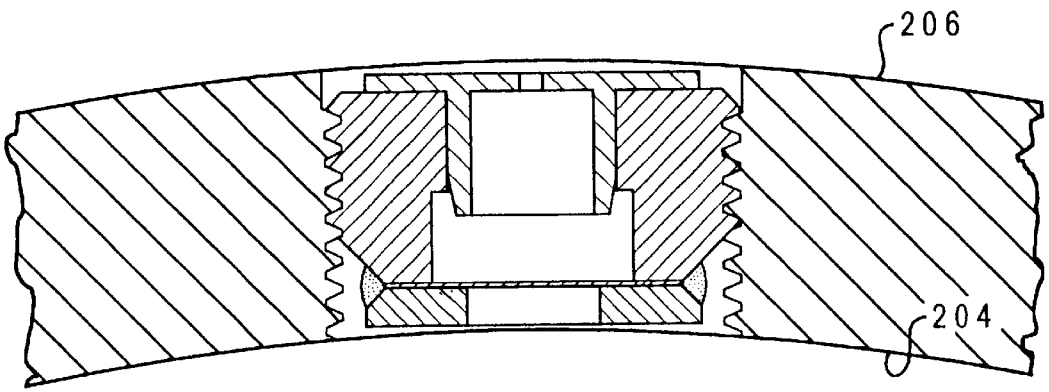
FIG. 2B is a cross sectional view of burst disk assembly installed in a casing using thread.
Figure 2C:
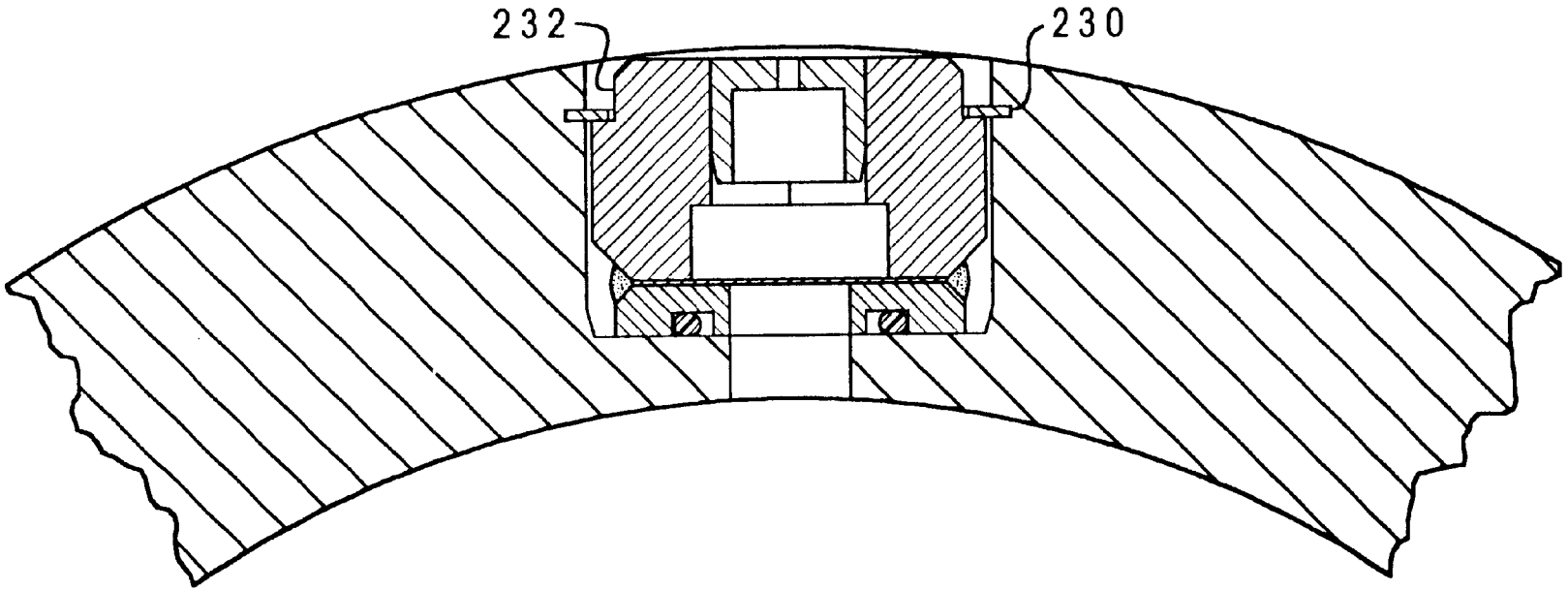
FIG. 2C is a cross sectional view of burst disk assembly installed in a casing using a snap ring.

The burst disk assembly 100 is inserted into a modified casing coupling 202 shown in FIGS. 2A and 2B. The modified coupling 202 is illustrated in cross section, as viewed from above in FIGS. 2A and 2B and includes an internal diameter 204 and an external diameter 206. An internal recess 208 is provided for receiving the burst disk assembly 100. The internal recess 208 has a bottom wall portion 212 and sidewalls 210. The sidewalls 210 are threaded along the length thereof for engaging the mating threaded region 114 on the main body 106 of the burst disk assembly 100. The threaded region 114 on body 106 may be, for example, 12 UNF threads. The burst disk assembly 100 is secured in the internal recess 208 by using an applied force of approximately 200 ft pounds of torque using a hex torque wrench. The 200 ft pounds of torque is used to ensure the o-ring 128 is securely seated and sealed on the bottom wall portion 212 of the internal recess 208.

It is possible that the o-ring 128 can not be used in certain casings because of a very thin wall region or diameter 204 of the modified coupling 202. For example, sometimes a 16-inch casing is used inside a 20-inch casing, leaving very little room inside the string. Normally a 16-inch coupling has an outside diameter of 17-inches, however in this instance the coupling would have to be 16½ inches in diameter to compensate for the lack of space. Consequently, the casing wall would be very thin and there would not be enough room to machine the cylindrical internal recess 208 and leave material at the bottom wall portion 212 for the o-ring 128 to seat against. In this case, instead of using an o-ring 128 to seal the burst disk assembly 100, NPT threads can be used. This version of the coupling and burst disk assembly is illustrated in FIG. 2B. The assembly is similar to that of FIG. 2A except that the NPT application has a tapered thread as opposed to a straight UNF thread when an o-ring 128 is used.

Snap rings 230 may also provide the securing means. Instead of providing a threaded region 114 on the body 106, a ridge or lip 232 would extend from the body 106. Also, the threaded sidewalls 210 in the internal recess 208 would be replaced with a mechanism for securing the burst disk assembly 100 inside the internal recess 208 by engaging the lip or ridge that extends from the body 106.

The installation and operation of the burst disk assembly of the invention will now be described. The pressure at which the burst disk 102 fails is calculated using the temperature of the formation and the pressure where either the inner string would collapse or the outer casing would burst, whichever is less. Also, the burst disk 100 must be able to withstand a certain threshold pressure. The typical pressure of a well will depend on depth and can be anywhere from about 1,400 psi to 7,500 psi. Once the outer string has been set, it must be pressure tested to ensure the cement permits a good seal and the string is set properly in place. After the outer casing has been pressure tested, the inner casing is set. The inner casing has a certain value that it can stand externally before it collapses in on itself. A pressure range is determined that is greater than the test pressure of the outer casing but less than the collapse pressure of the inner casing.

After allowing for temperature compensation, a suitable burst disk assembly 100 is chosen based on the pressure range. Production fluid temperature is generally between 110° F.–300° F. There is a temperature gradient inside the well and a temperature loss of 40–50° F. to the outer casing where the bust disk assembly 100 is located is typical. The temperature gradient is present because the heat has to be transferred through the production pipe into the next annulus, then to the next casing where the bust disk assembly 100 is located. Also, some heat gets transferred into the formation. At a given temperature the burst disk 102 has a specific strength. As the temperature goes up, the strength of the burst disk 102 goes down. Therefore, as the temperature goes up, the burst pressure of the burst disk 102 decreases. This loss of strength at elevated temperatures is overcome by compensating for the loss of strength at a given temperature.

Often times the pressure of the well is unknown until just before the modified coupling 202 is installed and sent down into the well. The burst disk assembly 100 can be installed on location at any time before the coupling 202 is sent into the well. Also, depending on the situation, the modified coupling 202 may need to be changed or something could happen at the last minute to change the pressure rating thereby requiring an existing burst disk assembly 100 to be taken out and replaced. To be prepared, several bursts disk assemblies 100 could be ordered to cover a range of pressures. Then when the exact pressure is know, the correct burst disk assembly 100 could be installed just before the modified coupling 202 is sent into the well.

When the burst disk 102 fails, the material of the disk splits in the center and then radially outward and the comers pop up. The split disk material remains a solid piece with no loose parts and looks like a flower that has opened or a banana which has been peeled with the parts remaining intact. The protective cap 112 is blown out of the way and into the annulus.

The pressure at which the burst disk 102 fails can be specified by the user, and is compensated for temperature. The burst disk 102 fails when the trapped annular pressure threatens the integrity of either the outer or inner string. The design allows for the burst disk assembly 100 to be installed in the factory or in the field. A protective cap 112 is included to protect the burst disk 102 during shipping and handling of the pipe.

An invention has been described with several advantages. The modified string of casing will hold a sufficient internal pressure to allow for pressure testing of the casing and will reliably release or burst when the pressure reaches a predetermined level. This predetermined level is less than collapse pressure of the inner string and less than the burst pressure of the outer string. The burst disk assembly of the invention is relatively inexpensive to manufacture and is reliable in operation within a fixed, fairly narrow range of pressure.

While the invention is shown in only one of its forms, it is not thus limited but is susceptible to various changes and modifications without departing from the spirit thereof.

What is claimed is:

1. In combination, a subsea well head connected by a subsea conduit to a floating work station, the subsea well head being connected to a plurality of casing strings located in a borehole below the subsea well head, the combination further comprising:

a modified casing coupling having at least one receptacle for housing a modular burst disk assembly including a burst disk, the modified casing coupling being located within at last one of the plurality of casing strings located in the borehole below the subsea well head;

a burst disk assembly Installed within the receptacle of the modified casing coupling, the burst disk of the burst disk assembly being exposed to annular pressure trapped between successive lengths of well casing located into borehole; and the burst disk being constructed of a material which is selected to fail at a pressure specified by a user.

2. The burst disk assembly of claim 1, wherein the burst disk assembly comprises a cylindrical main body having an upper region and a lower region with the lower region having an internal annular recess and the upper region having a hex hole which communicates with the annular recess for the insertion of a hex wrench;

a disk retainer having an upper surface and a lower surface and a bore that communicates the upper and lower surfaces; and a burst disk interposed between the main cylindrical body and the upper surface of the disk retainer, the burst disk being exposed to annular pressure trapped between successive lengths of well casing; and the burst disk assembly further comprising an o-ring groove in the bottom surface of the disk retainer for the insertion of an o-ring.

3. The burst disk assembly of claim 2 further comprising an externally threaded surface on the upper region of the cylindrical main body.

4. The burst disk assembly of claim 3 wherein the threaded surface has threads which are UNF threads.

5. The burst disk assembly of claim 3 wherein the threaded surface has threads which are NPT threads.

6. The burst disk assembly of claim 2 further comprising a ridge or lip located on the upper region of the main body to act as a snap ring.

7. The burst disk assembly of claim 1 wherein the burst disk is made of INCONEL™.

8. The burst disk assembly of claim 2 wherein the main body and the disk retainer are made of 316 stainless steel.

* * * * *